United States Patent [19]

Nichols, deceased

[11] 4,423,562

[45] Jan. 3, 1984

[54] COMBINATION WALL CALENDAR AND SUPPORT

[75] Inventor: Gordon E. Nichols, deceased, late of Middleboro, Mass., by Madeleine Nichols, administrator

[73] Assignee: Winthrop-Atkins Co., Inc., Middleboro, Mass.

[21] Appl. No.: 406,205

[22] Filed: Aug. 9, 1982

[51] Int. Cl.[3] ..... B42D 5/04; B43L 1/00

[52] U.S. Cl. ..... 40/107; 283/2

[58] Field of Search ..... 40/107, 116, 120; 283/2

[56] References Cited

U.S. PATENT DOCUMENTS 199,764 1/1878 Watson ..... 40/116 X R 3,482,346 12/1969 Woofter ..... 40/120

3,605,306 9/1971 Diambra et al. ..... 40/107

*Primary Examiner*—Henry F. Epstein

*Attorney, Agent, or Firm*—Robert T. Gammons

[57] ABSTRACT

A combination wall calendar and support for accommodating writing materials comprising a back panel provided with an aperture by means of which it can be suspended on a wall, a front panel for receiving a calendar pad, photograph or the like, a panel which may optionally be positioned in a plane parallel to the back panel or positioned forwardly thereof at an angle appropriate to provide an inclined writing surface and second and third panels for supporting the first panel in said writing position and defining a pocket for receiving and storing writing materials.

4 Claims, 5 Drawing Figures

COMBINATION WALL CALENDAR AND SUPPORT

BACKGROUND OF INVENTION

Combination wall and desk calendars are not new as shown, for example, in U.S. Pat No. 199,764, now U.S. Pat. No. 4,302,576 and U.S. Pat. No. 3,482,346. In each of the aforesaid structures, there is a back panel and a desk panel hinged to the front side thereof which may be swung away from the back panel and supported in a downwardly-inclined position by means of a prop. In that respect, the calendar of the instant invention has in common to the aforesaid patents a back panel, a desk panel which may be supported in a forwardly and downwardly-inclined position and a prop for supporting the desk panel. However, unlike the aforesaid patents, the prop in that of the instant invention is designed to enable automatically moving the desk panel to its operative position and to provide support for a writing implement at the lower edge of the writing surface and in combination with the desk panel and the back panel a pocket for receiving and storing writing materials. Additionally, the combination wall calendar and support is so structured as to make it extremely simple to manufacture by a single die-cutting operation.

SUMMARY OF INVENTION

As herein illusrated, the combination wall calendar and support of this invention comprises a back panel, a face panel positioned upon the back panel, said face panel having an upper edge coinciding with the upper edge of the back panel and a lower edge spaced from and parallel to the lower edge of the back panel and intermediate the lower edge of the face panel and the lower edge of the back panel a structure comprising a first downwardly and forwardly-inclined panel defining an inclined surface appropriate to the use of writing materials and a second upwardly and forwardly-inclined panel connected at its upper edge with the lower edge of the first panel and supported at its lower edge from the back panel, said first and second panels defining in conjunction at their intersections with each other a transversely-elongate, forwardly and upwardly-projecting ledge appropriate to retaining a writing implement placed thereon at the bottom of the writing surface and in conjunction with the back panel a transversely-elongate pocket between the first, second and back panels open at its ends of an appropriate size to receive and store writing material. There is a third panel connected at one edge to the back panel and at its other edge to the second panel supporting the second panel from the back panel. The structure comprising the first, second and third panels has a combined length which is less than the distance between the lower edge of the first panel and the lower edge of the back panel and there is hinge means connecting one edge of the first panel to the back panel, hinge means connecting the other edge to one edge of the second panel, hinge means connecting the other edge of the second panel to one edge of the third panel and hinge means connecting the other edge of the third panel to the lower edge of the back panel. The combined length of the first and second panels equals the combined length of the portion of the back panel below the first panel plus the length of the third panel. The structure comprising the back, front, first, second and third panels has two possible positions, a first position in which the third panel is an in-plane extension of the back panel and the first and second panels lie in a common plane parallel to the plane of the back panel and third panel and a second position in which the first and second panels extend forwardly from the back panel at angles to the back panel and the third panel. The ledge is formed by an integral extension of the second panel cut out of the first panel.

The structure is formed of a blank comprising a back panel of predetermined length, a front panel of lesser length hingedly connected to one end of the back panel, first, second and third panels having a total length of less than the difference between the length of the back and front panels and hinges connecting the front and third panels to the back panel along a line coinciding with the line defining the difference in length between the back panel and the first panel and the other edge of the back panel and a hinge connecting the first and second panels. There is a U-shaped cut at the intersection of the front and second panels, first and second panels, the bottom of which lies in the first panel spaced from and parallel to the hinge and the legs of which cross the hinge line from the first panel into the second panel.

The invention will now be described in greater detail with reference to the accompanying drawings, wherein.

Figure 1:
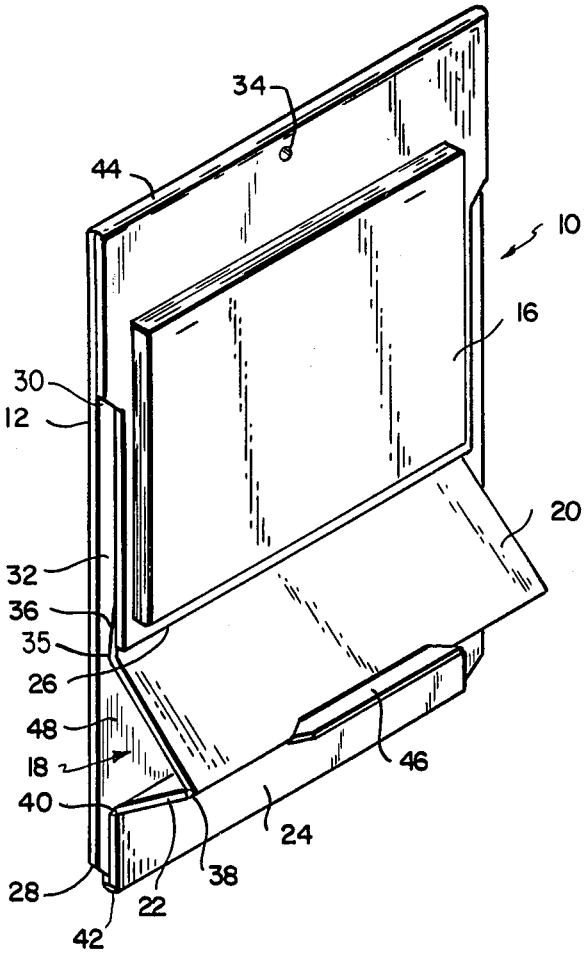
FIG. 1 is a perspective of the wall calendar with the writing surface distended at an angle for writing.

Referring to the drawings, FIG. 1, the combination wall calendar and writing support 10 comprises a back panel 12 adapted to be suspended on a wall, a front panel 14 for supporting a calendar pad 16 or photograph and a support 18 below the front panel comprising a first panel 20 which, when disposed at a downwardly and forwardly-inclined angle to the front panel, defines a writing surface and two supporting panels 22 and 24.

The back panel 12 is of rectangular configuration and of a predetermined length greater than that of the front panel 14 so that its lower edge 26 is spaced from and parallel to the lower edge 28 of the back panel. As herein illustrated, the opposite side edges of the front panel are notched at 30 so that portions of the back panel at opposite sides of the front panel are visible at the front side.

The calendar pad 16 or a photograph, as desired, may be attached by stapling to the front panel or by means of adhesive and advertising matter can be printed on the front panel above the calendar pad. An aperture 34 through the front and back panels provides for suspending the wall calendar from a wall.

As previously stated, the first panel 20, when positioned at an angle inclined forwardly and downwardly from the front panel 14, affords a writing surface and, to provide for positioning the panel 20 at a forwardly and downwardly-inclined angle, the upper edge of the panel 20 is connected by a hinge 35 to an attaching tab 36, the latter being stapled to the back panel behind the lower edge of the front panel 14. As illustrated, the hinge 35 coincides with and is parallel to the lower edge of the front panel 14. The lower edge of the panel 20 is connected by a hinge 38 to the upper edge of the support panel 22 and the lower edge of the support panel 22 is connected by a hinge 40 to the upper end of the support panel 24, the latter being connected at its lower edge by hinge 42 to the lower edge 28 of the back panel 12.

The combined length of the panels 20, 22 and 24 is greater than the difference in length between the length of the back panel 12 and the front panel 14 so that when the support panel 24 is disposed upwardly in engagement with the front side of the back panel 12, the panels 20 and 22 are forced to protrude or project outwardly from the front face 32 of the back panel 12 at an angle such that the panel 20 is inclined downwardly and forwardly from the front face 32 of the back panel and the panel 22 is inclined upwardly and forwardly from the front face 32 of the back panel. As illustrated, the front panel is connected to the upper edge of the back panel 12 by a hinge 44. The front panel 14 thus hangs downwardly over the front face 32 of the back panel 12 and is unconnected at its lower edge to the front side of the back panel.

At the intersection of the panel 20 and the panel 22, there is a forwardly-protruding shelf 46 upon which may be placed a writing implement in a convenient position to be picked up and used for making notes on pad paper resting on the writing surface 20. In combination, that portion of the back panel behind the panel 20 and the panel 22 defines a pocket 48 open at its ends of such size as to receive and store writing materials such as a pad of paper and a pencil or pen. The surface of the panel 24 below the paper 22 may be used to receive emergency telephone numbers such as police, fire, hospital, doctor and the like.

Figure 2:
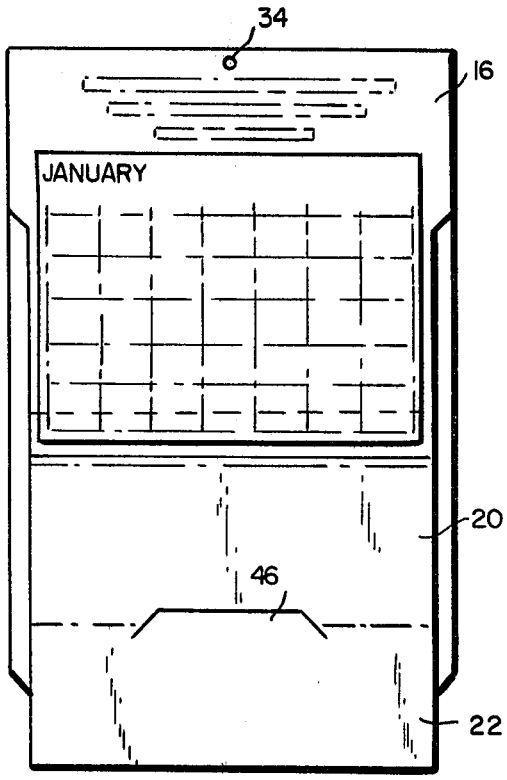
FIG. 2 is a front elevation of the combination wall calendar and support with the support collapsed into the plane of the back panel.
Figure 3:
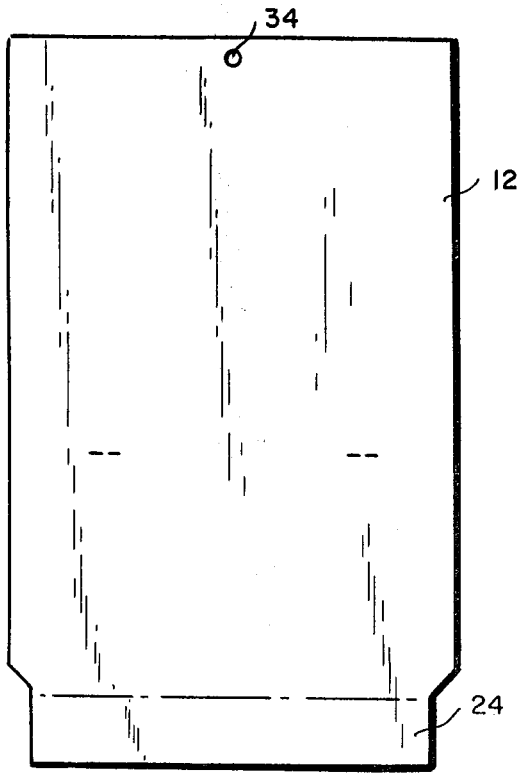
FIG. 3 is a rear elevation of FIG. 2.
Figure 4:
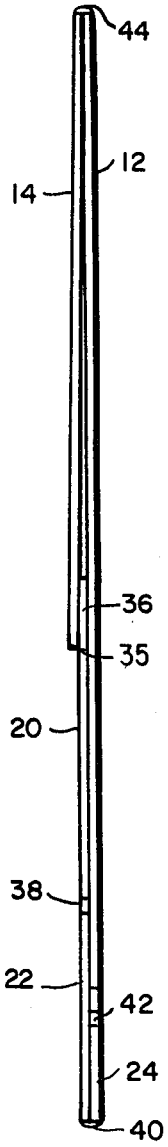
FIG. 4 is an edge view to somewhat larger scale taken from the right side of FIG. 2.

The structure shown in FIG. 1 is shown in a position in which the panel 20 is disposed at an angle appropriate for jotting down notes and the like. FIG. 2 shows a front elevation of the structure collapsed, that is, with the panels 20 and 22 in a common plane parallel to the back panel 12 and the panel 24 in an in-plane extension with the back panel. FIG. 4 is a back view of the structure folded as shown in FIG. 2.

Figure 5:
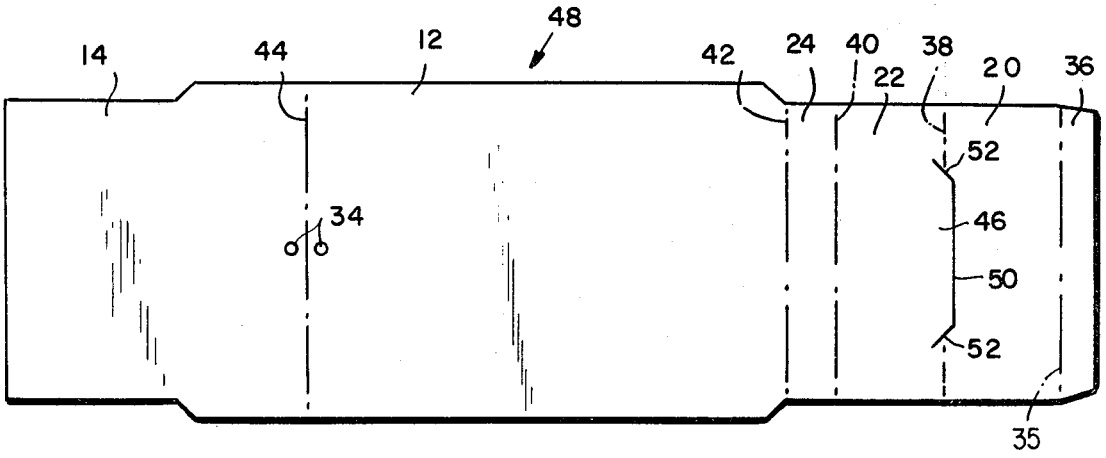
FIG. 5 is a plan view of the blank of which the wall calendar is made.

The structure is die-cut from sheet material in the form of a blank 48, FIG. 5, of stiff cardboard faced on one or both surfaces with a decorative covering material. The panels constituting the structure of the blank bear the corresponding reference characters shown in FIG. 1 comprising in the order named a back panel 12, a front panel 14 connected at one edge to the back panel 12 by a hinge 44, a support panel 24 connected at one edge by a hinge 42 to the opposite edge of the back panel 12, a support panel 22 connected at one edge by a hinge 40 to the other edge of the support panel 24 and a support panel 20 connected at one edge by a hinge 38 to the panel 22. The tab 36 is connected by a hinge 35 to the panel 20. The shelf 46 at the intersection of the panels 20 and 22 is formed by a cut 50 in the panel 20 spaced from and parallel to the hinge 38 and two cuts 52—52 at the ends of the cut 50 crossing from the panel 20 into the panel 22. The hinges connecting the respective panels are formed by the facing material covering the opposite faces of the blank and afford an elastic resistance to folding of the panels with respect to each other such that when the panels 20, 22 and 24 are folded forwardly from the planes in which they lie parallel to each other to the forwardly-projecting position by pushing inwardly of the lower hinge 42, the panels will automatically snap into their forwardly-disposed position and remain firmly in place until dislodged by folding the lower panel 24 outwardly relative to the back panel about the hinge 42.

The structure as thus described is very simple to manufacture, provides an attractive and useful accessory for keeping track of dates, emergency telephone numbers and for the making of memoranda.

It should be understood that the present disclosure is for the purpose of illustration only and includes all modifications or improvements which fall within the scope of the appended claims.

What is claimed is:

1. A combination wall calendar and support comprising a back panel of predetermined length having back and front sides, a face panel of shorter length than the back panel disposed in face-to-face contact with the front side of the back panel with its ends parallel to the ends of the back panel and with its lower end spaced from the lower end of the back panel, a forwardly and downwardly-inclined supported panel at the lower end of the face panel, a pair of hingedly-connected supporting panels supporting the supported panel in said forwardly and downwardly-inclined position, one of said supporting panels being hingedly connected to the lower end of the supported panel and the other to the lower end of the back panel, said supported and supporting panels collectively exceeding the length of the distance between the lower end of the face panel and the lower end of the back panel, one of said supporting panels being disposed to extend upwardly from the lower end of the back panel in contact with the front face of the back panel and the other to extend outwardly and upwardly from the upper end of the one panel at an angle to the front face of the back panel to the lower edge of the supporting panel such that the supported panel and the outwardly and upwardly-extending disposed supporting panel define, in conjunction with the back panel, a continuous passage transversely of the structure in the form of an open-ended pocket suitable to receive writing materials and a lip at the junction of the lower end of the supported panel with the upper end of the outwardly and upwardly-positioned supporting panel cut out of the supported panel, integral with the upwardly and outwardly-positioned supporting panel and projecting forwardly from the lower end of the supported panel in the plane of the upwardly and outwardly-positioned supporting panel defining a shelf suitable to support a writing implement at the lower end of the supporting panel.

2. A combination wall calendar and support comprising a back panel of predetermined length having back and front sides, a face panel of lesser length hinged at one end to the upper end of the back panel, said face panel having back and front sides and extending from its hinged connection with the upper end of the back panel downwardly therefrom with its back side in contact with the front side of the back panel toward the lower end of the back panel, said face panel terminating short of the lower end of the back panel, a forwardly and downwardly-inclined supported panel at the lower end of the face panel, a pair of hingedly-connected support panels supporting the supported panel in said forwardly and downwardly-inclined position, one of said supporting panels being hingedly-connected to the lower end of the supported panel and the other of which is hingedly connected to the lower end of the back panel, said supported and supporting panels collectively exceeding in length the distance between the lower end of the face panel and the lower end of the back panels, said support panels being disposed with one end extending upwardly from the lower end of the back panel in contact with the front side of the back panel and the other extending outwardly and upwardly at an angle to the front face of the back panel to the lower end of the supported panel such that the supported panel and the outwardly and upwardly-disposed supporting panel define, in conjunction with the back panel, a continuous passage transversely of the structure in the form of an open-ended pocket suitable to receive writing material and a lip at the junction of the lower end of the supported panel with the upper end of the upwardly and outwardly-extending supporting panel cut out of the supported panel integral with the upwardly and outwardly-positioned supporting panel and projecting forwardly from the lower end of the supported panel in the plane of the upwardly and outwardly-positioned supporting panel defining a shelf suitable to support a writing implement at the lower end of the supported panel.

3. A combination according to claim 1 wherein the collective length of the supported panel and the supporting panels exceeds the distance between the lower end of the face panel and the lower end of the back panel such that the supported panel and one of the supporting panels connected thereto can be disposed in a common plane in front of the back panel and the supporting panel connected to the lower end of the back panel can be disposed behind in the plane of the back panel.

4. A combination according to claim 1 wherein the supporting panels hingedly connected to the lower ends of the supported panel and the back panel are operable on the one hand to position the supported panel in its inclined position relative to the back panel and on the other hand to dispose it in parallel relation to the back panel.

* * * * *